US008540233B2

(12) United States Patent
Parks et al.

(10) Patent No.: US 8,540,233 B2
(45) Date of Patent: Sep. 24, 2013

(54) RETARD FEEDER

(75) Inventors: Ian A Parks, Hertfordshire (GB); Neil Flynn, Bedfordshire (GB); Samuel Hagos, London (GB); Christopher Pearce, Hertfordshire (GB); Stephen P Wood, Bedfordshire (GB); Richard G Hubbard, Bedfordshire (GB); Allan D Mciver, Hertfordshire (GB); Justin Chase, Sandy (GB)

(73) Assignee: Xerox Corporation, Norwalk, CT (US)

( * ) Notice: Subject to any disclaimer, the term of this patent is extended or adjusted under 35 U.S.C. 154(b) by 461 days.

(21) Appl. No.: 12/964,768

(22) Filed: Dec. 10, 2010

(65) Prior Publication Data

US 2012/0147435 A1 Jun. 14, 2012

(51) Int. Cl.
*B65H 3/52* (2006.01)

(52) U.S. Cl.
USPC ..... 271/125

(58) Field of Classification Search
USPC ..... 271/125
See application file for complete search history.

(56) References Cited

U.S. PATENT DOCUMENTS

| | | | | |
|---|---|---|---|---|
| 3,905,458 | A | 9/1975 | Mehrbrodt | |
| 5,085,420 | A * | 2/1992 | Sata | 271/114 |
| 5,992,993 | A * | 11/1999 | Kiyohara et al. | 347/104 |
| 6,457,707 | B1 * | 10/2002 | Hendrix et al. | 271/117 |
| 6,644,656 | B2 * | 11/2003 | Muranaka | 271/225 |
| 6,708,971 | B1 * | 3/2004 | Sasaki et al. | 271/117 |
| 7,410,161 | B2 * | 8/2008 | Yamamoto | 271/124 |
| 7,464,923 | B2 | 12/2008 | Faguy et al. | |
| 2010/0289210 | A1 * | 11/2010 | Nakazawa | 271/225 |
| 2012/0242030 | A1 * | 9/2012 | Hayakawa et al. | 271/10.13 |

* cited by examiner

*Primary Examiner* — Prasad Gokhale

(57) ABSTRACT

A method for providing increased performance in fully active retard feeders includes driving a feed roll and retard roll pair of a reprographic apparatus backwards periodically at the start of the machine or during idle periods to compensate for contamination buildup and/or roll "set" when left in position overnight.

10 Claims, 2 Drawing Sheets

RETARD FEEDER

BACKGROUND

1. Field of the Disclosure

This invention relates in general to an image forming apparatus, and more particularly, to an image forming apparatus employing an improved fully active retard feeder (FAR).

2. Description of Related Art

In reprographic machines, an important operation involves the feeding of copy sheets. One device for accomplishing this act is a retard feeder, such as, disclosed in U.S. Pat. No. 7,464,923. It is generally accepted that a fully active retard feeder works better after the first few sheets have been fed. This may be due to heat build up in the feed rolls giving the rolls a higher coefficient of friction. Another possibility could be that due to scuffing of rolls against each other cleaning away any surface debris that would give a drop in coefficient of friction. Additionally, the rolls tend to take a "set" when left in one position overnight, but once they start to revolve this "set" is eliminated. A problem with the FAR feeder is that this poor feeding of the first few sheets can lead to skipped pitches and/or misfeeds.

Given that the vast majority of customer jobs run only a few pages in length, performance improvement in FAR feeders is a necessity.

BRIEF SUMMARY OF THE DISCLOSURE

Accordingly, an improved device and method for providing increased performance in FAR feeders is disclosed that comprises driving a feed roll pair of a reprographic apparatus backwards periodically at the start of the machine or during idle periods to compensate for contamination buildup and/or roll "set" when left in position overnight.

The disclosed reprographic system that incorporates the disclosed FAR feeder with the improved pre and post feed cycle routines may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' or 'reprographic device' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed.

As to specific components of the subject apparatus or methods, or alternatives therefore, it will be appreciated that, as is normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
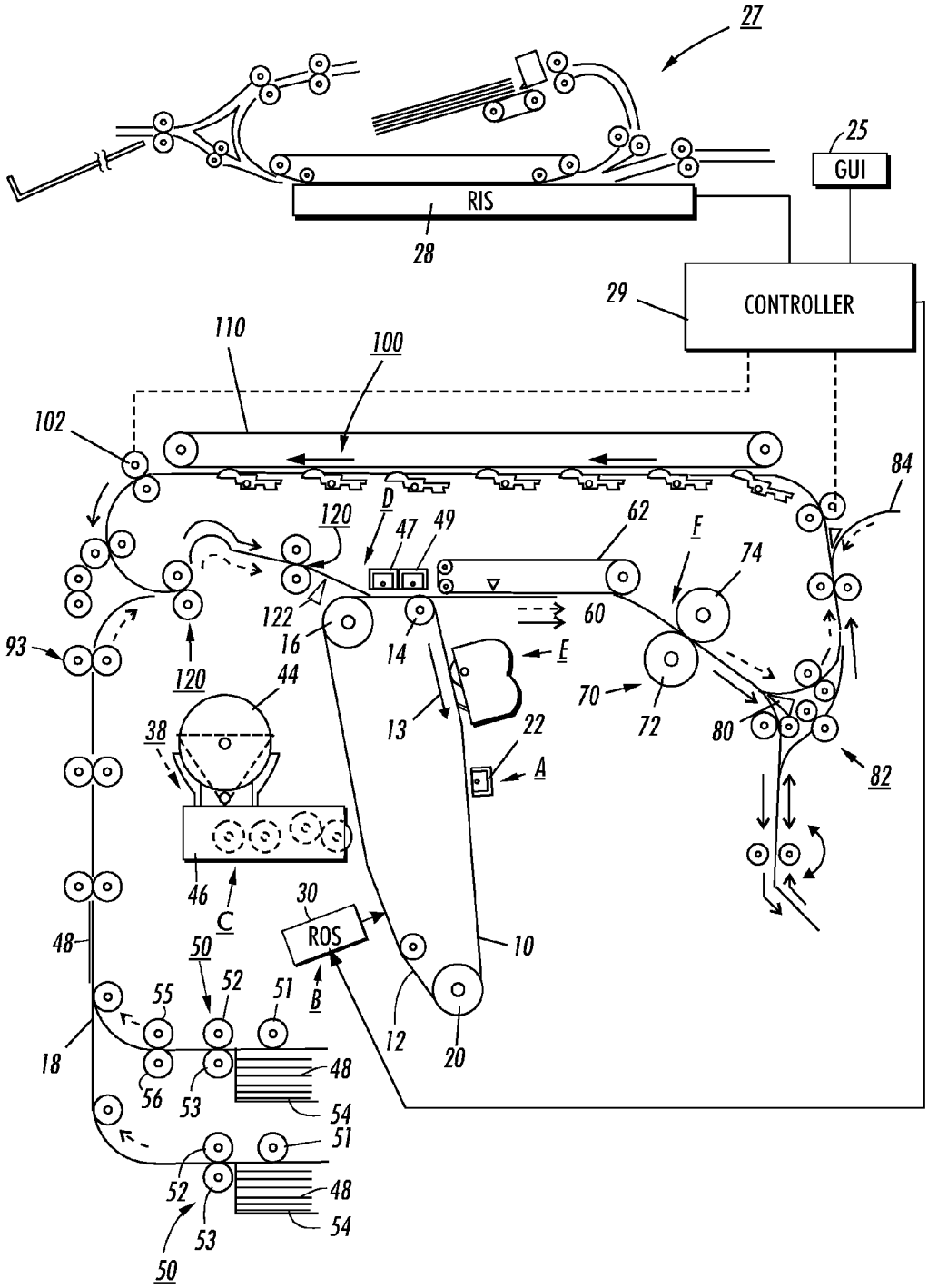
FIG. 1 is a frontal view of an exemplary xerographic printer that includes the improved friction retard feeder apparatus.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

For a general understanding of the features of the disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet fully active retard feeding apparatus, 50. Preferably, sheet feeding apparatus 50 includes a nudger roll 51 which feeds the uppermost sheet of stack 54 to a nip formed by feed roll 52 and a retard roll 53. Retard roll 53 is mounted on shaft 91 and controlled by controller 29 through a conventional clutch, such as, a wrap spring clutch as disclosed in U.S. Pat. No. 3,905,458. Feed roll 52 rotates to advance the sheet from stack 54 into vertical transport 18. Vertical transport 18 directs the advancing sheet 48 of support material into the registration transport 120 which, in turn, advances the sheet 48 past image transfer station D to receive an image from photoconductive belt 10 in a timed sequence so that the toner powder image formed thereon contacts the advancing sheet 48 at transfer station D. Transfer station D includes a corona generating device 47 which sprays ions onto the back side of sheet 48. This attracts the toner powder image from photoconductive surface 12 to sheet 48. The sheet is then detacked from the photoreceptor by corona generating device 49 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70, which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor that controls all of the machine functions hereinbefore described. The controller provides a comparison count of the copy sheets, the number of documents being recirculated, the number of documents being recirculated, the number of copy sheets selected by the operator, time delays, jam corrections, receive signals from full width or partial width array sensors and calculate skew in sheets passing over the sensors, calculate the change in skew, the speed of the sheet and an overall comparison of the detected motion of sheets with a reference or nominal motion through a particular portion of the machine.

Figure 2:
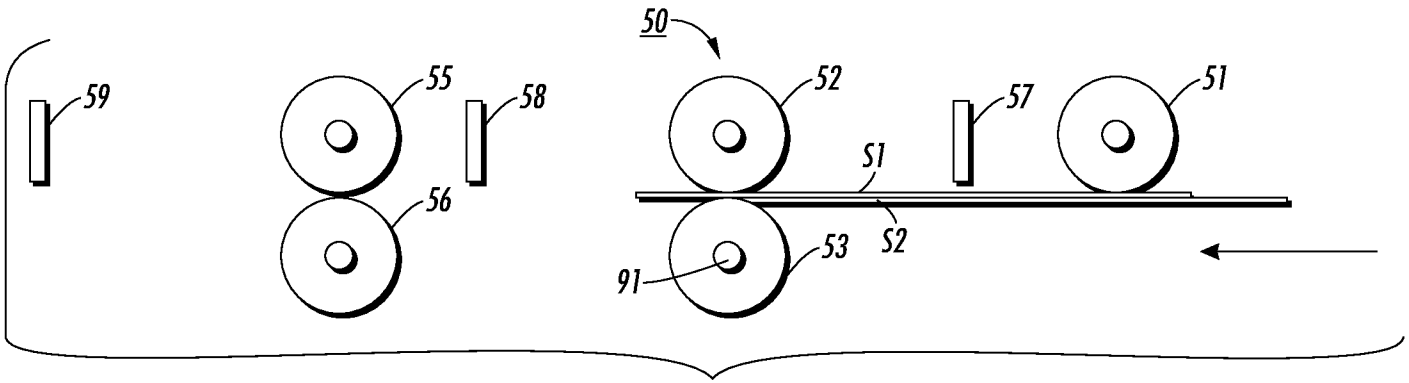
FIG. 2 is an exploded, partial schematic side view of a one embodiment of the retard sheet feeder apparatus that includes the improved pre and post feed routines.

Fully active retard sheet separator/feeder 50 is a friction retard top sheet feeder that will now be described with particular reference to FIG. 2. Sheets 48 are fed from a stack by nudger roll 51 which engages the top sheet in the stack and on rotation feeds the top sheet towards a nip formed between separation or feed roll 52 and retard roll 53. Feeding from tray 54 by nudger roll 51 is obtained by creating a stack normal force (e.g., of 1.5 Newtons) between the nudger roll and the paper stack. This force is achieved by the weight of the nudger wheel and its associated components acting under gravity.

At the beginning of a print cycle, the machine logic will interrogate the system to determine if any paper is in the paper path. If there is no paper in the paper path, the logic will initiate a signal to a feed clutch in nudger 51, thereby starting the feeder. The nudger roll 51 will drive the top sheet of paper 48 into the nip between feed roll 52 and retard roll 53. Microswitch 57 indicates when a sheet has been forwarded by the nudger roll. As the feed roll rotates, it drags a sheet of paper from the stack. Frictional forces and static electricity between the sheets of paper in the stack may cause several sheets to move into the nip together.

If several sheets of paper approach the nip together, the friction between the retard roll 53 and the bottom sheet of those being fed is greater than that between two sheets. The friction between the feed roll 52 and the top sheet S1 is greater than the friction between two sheets. The group of sheets being fed towards the nip will therefore tend to become staggered around the curved surface of the retard roll up into the nip, until the lower sheet S2 of the top two sheets is retained by the retard roll 53, while the topmost sheet is fed by the feed roll 52. Of course, in order for this to happen, the friction between the feed roll 52 and a paper sheet must be greater than the friction between a paper sheet and the retard roll 53. Therefore, the feed roll 52 drives the top sheet S1 away from the stack and the next sheet S2 is retained in the nip to be fed next. Microswitch 58 communicates to controller 29 whether a sheet has reached that point in feeding.

The feed clutch remains energized until paper is sensed by the input microswitch 59. Paper, whose leading edge has reached this switch 59, is under the control of the takeaway rolls 55, 56 that drive the sheet towards registration transport 120 shown in FIG. 1.

In order to prevent misfeeds and/or skipped pitches during feeding and in accordance with the present disclosure, prior to feeding, a motor drivingly connected to feed roll 52 and retard roll 53 is turned ON and the retard roll is driven in a reverse direction to paper feed. The drive of retard roll 53 will cause feed roll 52 to drive in the opposite direction as it slips on a one-way clutch. As the feed and retard roll are driving in the reverse direction, the nudger roll 51 will remain motionless. Any paper in the vicinity of the nip between feed roll 52 and retard roll 53 will either remain motionless or will be driven in reverse back to the stack 54. The motion of the retard roll drive will warm, clean and de-flat the retard and feed rolls. This will prepare the two components in readiness for feeding a sheet of paper out of stack 54.

In addition to or alternatively, the feed roll and retard roll pair 52, 53 are periodically rotated backwards at predetermined times during idle periods of the machine to alleviate contamination built-up and/or roll "set".

It should now be understood that a FAR paper feed system has been disclosed which employs a feed roll pair that is driven backward periodically prior to an initial feeding sequence and/or during idle periods of the machine to alleviate contamination built-up and roll "set". In view of the fact that the vast majority of customer jobs are only a few pages, this technique represents a big improvement over present FAR feeders. Various events are contemplated that could trigger the disclosed procedures for "de-flatting" the drive and retards rolls including, for example, time, humidity, temperature, roll materials, etc.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for removing roll set and debris contamination from separation and retard rolls of a sheet feeder before feeding a first sheet from a sheet stack; comprising:

providing a sheet feeder, said sheet feeder including a separation roll that feeds sheets to a downstream location and a retard roll that forms a sheet feeding nip therewith;

providing a motor drivingly connected to said separation and retard rolls;

energizing a controller, said controller being operatively connected to said motor and adapted when energized to send a signal to actuate said motor to rotate said separation and retard rolls in a backwards direction without touching said sheets prior to feeding said first sheet from said sheet stack;

removing said roll set and debris contamination from said separation and retard rolls with said backwards rotation of said separation and retard rolls; and sending said signal from said controller to said motor in response to expiration of predetermined time periods.

2. The method of claim 1, including sending said signal from said controller in response to humidity measurement reaching a predetermined threshold.

3. The method of claim 1, including incorporating said sheet feeder apparatus into a xerographic device.

4. The method of claim 3, including using said controller for periodically actuating said motor to drive said separation and retard rolls in said backwards direction during periods when said xerographic device is not being used by an operator.

5. The method of claim 4, including actuating said motor to perform a warm-up cycle that includes rotating said separation and retard rolls in a backwards direction at start-up of said xerographic device.

6. The method of claim 5, including performing said warm-up cycle after predetermined periods of feeder inactivity.

7. The method of claim 5, including increasing the temperature of said separation and retard rolls to thereby increase the coefficient of friction of said separation and retard rolls by performing said warm-up cycle.

8. The method of claim 3, including sending said signal from said controller based upon temperature readings within said reprographic device.

9. The method of claim 1, including sending said signal from said controller based upon materials used for said separation and retard rolls.

10. A method for removing roll set and debris contamination from separation and retard rolls of a sheet feeder positioned within a printer before feeding a first sheet from a sheet stack; comprising:

providing a sheet feeder, said sheet feeder including a separation roll that feeds copy sheets to a downstream location and a retard roll in mating relationship therewith;

providing a motor drivingly connected to said separation and retard rolls;

energizing a controller, said controller being operatively connected to said motor and adapted when energized to send a signal to actuate said motor to rotate said separation and retard rolls in a backwards direction without touching said copy sheets prior to feeding said first sheet from said sheet stack;

removing said roll set and debris contamination from said separation and retard rolls by rotating said separation and retard rolls in said backwards direction; and sending said signal periodically from said controller to said motor during periods when said printer is not being used by an operator.

* * * * *